United States Patent [19]

Whitaker

[11] 4,449,260

[45] May 22, 1984

[54] SWIMMING POOL CLEANING METHOD AND APPARATUS

[76] Inventor: Brackston T. Whitaker, 6020 E. Speedway, Tucson, Ariz. 85712

[21] Appl. No.: 413,708

[22] Filed: Sep. 1, 1982

[51] Int. Cl.[3] ..... E04H 3/18; E04H 3/20

[52] U.S. Cl. ..... 4/490; 4/492; 134/167 R; 134/168 R

[58] Field of Search ..... 4/492, 490; 134/167 R, 134/168 R, 168 C

[56] References Cited

U.S. PATENT DOCUMENTS

| | | | |
|---|---|---|---|
| 3,278,949 | 10/1966 | Whitaker | 4/490 X |
| 3,464,068 | 9/1969 | Whitaker | 4/490 |
| 3,530,511 | 9/1970 | Berg et al. | 4/490 |
| 3,570,017 | 3/1971 | Reece | 134/167 R |
| 3,577,571 | 5/1971 | Bellinson | 4/490 X |
| 3,585,654 | 6/1971 | Jacobs | 4/490 |
| 3,665,525 | 5/1972 | Howard | 4/492 |
| 3,797,508 | 3/1974 | Jacobs | 4/490 X |
| 3,820,172 | 6/1974 | Kane | 4/490 |
| 4,178,949 | 12/1979 | Mazon | 4/490 X |

*Primary Examiner*—Henry K. Artis

*Attorney, Agent, or Firm*—John Gibson Semmes

[57] ABSTRACT

Hydraulically operated low pressure reservoir or pool cleaning method and apparatus wherein, by the controlled passage of water through actuating valves, plural water exhaust whips are submersibly extended from a pool shell into the closure to agitate the pool water and scour the shell walls and floor, thereby to perform the cleaning function. The whips may thereafter be retracted into the walls and floor and retained, pending further useage as extended cleaning elements. Method and apparatus present economies of operation and installation, hitherto unknown.

11 Claims, 5 Drawing Figures

SWIMMING POOL CLEANING METHOD AND APPARATUS

BACKGROUND OF THE INVENTION

Prior Art

The invention, while specifically defined in terms of swimming pools hereinafter, clearly applies to any reservoir or vessel containing water or other fluids. Known prior art includes the extensible-retractible method and apparatus having genesis in the prior U.S. Letters Patents of applicant herein, Brackston T. Whitaker, U.S. Pat. No. 3,278,949 dated Oct. 18, 1966, entitled SWIMMING POOL CLEANING APPARATUS, and U.S. Pat. No. 3,464,068 dated Sept. 2, 1969, entitled SWIMMING POOL CLEANING SYSTEM. The principal features of improvement relate to the novel whip housings and operating control valve, the latter of which permits, through the use of valves, cross connections between the normal suction line, return line and heater lines. The basic positioning of the valves permits normal run and filtering with tubes retracted, cleaning with tubes extended, while simultaneously filtering and finally retracting the cleaning tubes from the pool interior, as will be explained hereinafter.

SUMMARY OF INVENTION

The invention is an improvement over the prior art as follows:

The invention comprises a hydraulically operated, low pressure automatic pool cleaning system. It operates in conjunction with the swimming pool filter, requiring neither additional pumping nor electrical connections. The system operates by diverting part of the return pool water through a network of flexible cleaning tubes built into the side walls and/or floor comprising the pool shell. Upon activation, water is expelled through the tubes, causing them to move, while extended, gently across the floor and walls of the pool, to push the dirt and debris into the main drain of the pool.

The cleaning tubes are retracted from the pool in the non-cleaning mode, by reversing direction of the water through them. The velocity of the water in the reverse direction and the vacuum thus created, cause the tubes to retract into fixed housing which have been installed on the shell of the pool.

In construction, a preselected number of the tube housings are set behind the steel basket of the pool, with one end of the tube housings penetrating the pool shell into the pool interior. This end is made flush with the interior wall or floor of the pool. The other end of the housing is connected to a header line which, in turn, is connected through a specific cross-valving to the pump and to the return line from the filter to the pool.

DESCRIPTION OF THE PREFERRED EMBODIMENTS

Figure 1:
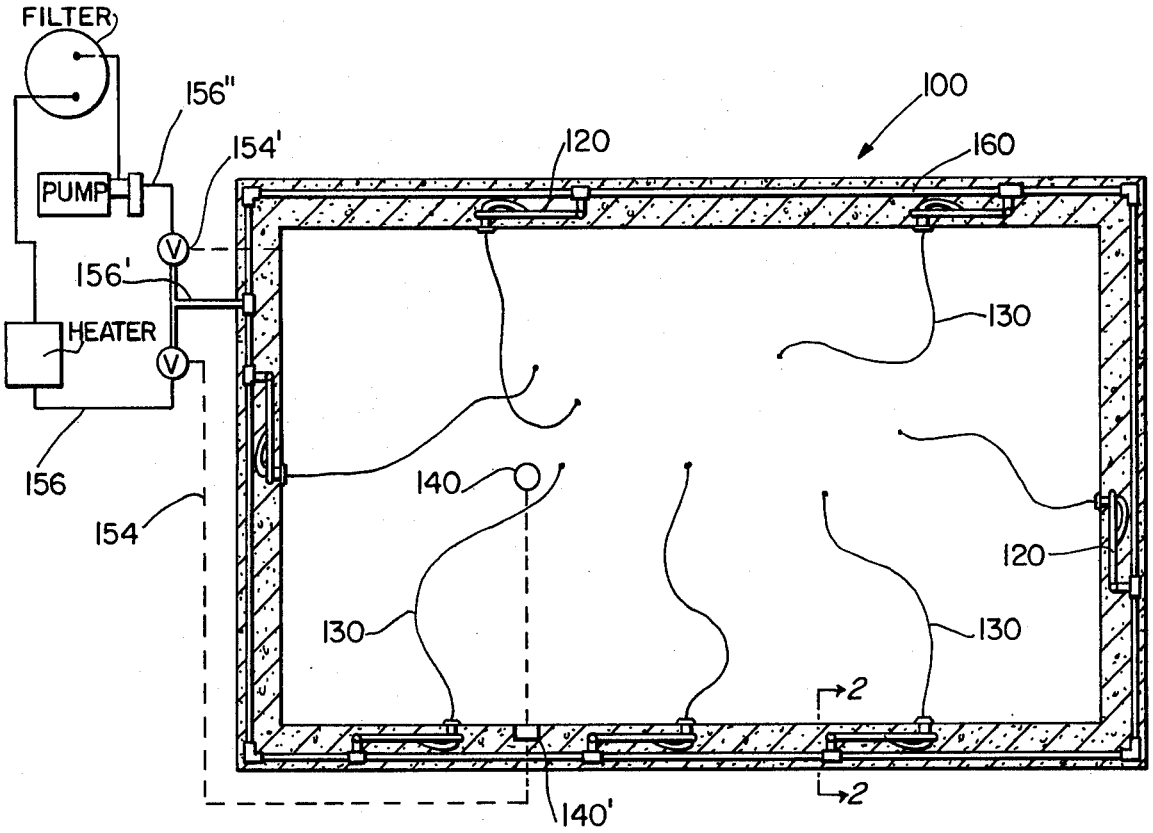
FIG. 1 is a view in top plan illustrating by schematic, the relative positioning of the spiral tube housings in the bond beam area of the pool, the whips retained thereby, being extended in the cleaning mode.
Figure 2:
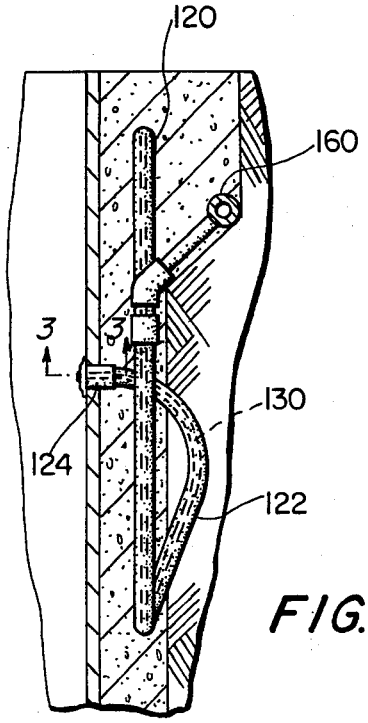
FIG. 2 is a vertical section view of the whip housings, set within the bond beam area of the tubes, and Figure being taken along the lines 2—2 of FIG.1 and comprising a vertical section.

In FIG. 1 there is a plot plan and longitudinal cross section of a typical installation of invention 100 wherein the various components thereof are shown installed. A plastic pipe header line 160 is installed completely around the outer perimeter of the pool. A connected spiral whip housing 120 is installed against the excavated surface of the pool. The spiral whips housing is adapted to retain the whips while retracted; thus for case of operation, its minor terminus portion 122 forms a 90 degree turn so that its whip adapter 124 opens onto the pool, perpendicular to the pool walls. Extensive-retractable whips 130 are thus when in storage, each seated in a spiral housing. The tubular whips are composed of any soft, pliable impermeable substance having long wear characteristics. The functions of the whips are twofold. First, they must circulate or move about while jetting a stream of water into the pool reservoir to agitate it. Secondly, they must continuously scour the pool surfaces, wall and floor of the shell. Each end of the whip terminates in a rounded, extremely durable plastic stopper head 132–132'. Each stopper head is permanently bonded to the pliable whip end. Stopper head 132', located within the walls of the spiral housing, can be moved freely in either direction as positive hydraulic pressure (extend and clean) or negative hydraulic pressure (retract) may be applied. When positive hydraulic pressure is applied, the stopper head 132 comes into direct seating contact with stopper plug 122 which is located on the pool shell and shaped interiorly to conform to the exterior configuration of the whip head. This direct contact prevents the positive exhaust pressure from driving the whip out into the pool and at the same time, prevents any pressurized water from leaking out between the stopper plug and the stopper head limiting the overall effectiveness of the cleaning whips. The stopper plug 124 functions in much the same way as the stopper plug 122. Stopper plug 124, however, prevents negative water pressure when applied from sucking the entire whip 130 up and into the pool pump through the direct seating of the stopper head with the said stopper plug 124. The actual working function of these long whips (16–18 feet long on average) is fully explained in the aforesaid U.S. Pat. Nos. 2,378,949 and 3,464,068.

The floor housing 120' is exactly like the wall unit except that this unit is installed against the earth on the excavated floor. The supply end thereof is connected to the header line and the terminal end is allowed to project through the finished floor of the pool. A spiral housing 120' is constructed so that it can be installed completely in the step area or other locations in the floor of the pool. This unit will differ from the side wall and floor unit in that it does not have a right angle turn at its terminal end. It is normally installed so that the terminal end extends through the bottom riser of the step and again, the supply end is connected to the main header line.

Operational valve assembly 150 controls the cross connection between the suction, return lines, and the pool cleaning elements, per se. There is a conventional main drain 140 and at least one skimmer 140', both on the suction side of the system, connecting, via line 154 to valve 150 at the other end. There is also a connecting suction line 156 between control valve 150 and the swimming pool pump. A return line 156'' connects the swimming pool filter to valve 150 and there is pool return line 154' to the swimming pool. Valve outlet 156' connects the control valve 150 in the bond beam to the header 160, to operate the extensible-retractible whips 130 as will be explained. In floor whips and housings are installed, these may be served by an additional header, not shown, located in the spring point area in the floor.

Figure 3:
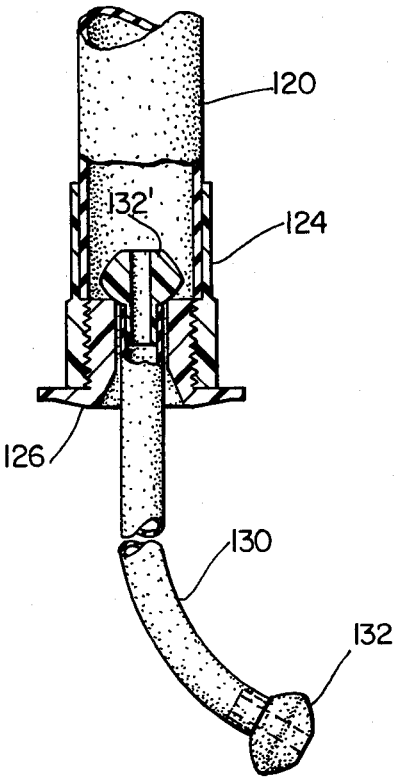
FIG. 3 is a plan view of whip housing adapter; with whip extended, a portion of the view being broken away.

The present system does eliminate the conventional vacuuming of the swimming pool and most of the brushing as the double-ended whips 130, reference FIG. 3, tend to scour the surfaces upon which they ride or come into contact. By utilizing this system, one thus saves a majority of the manual labor in maintaining a swimming pool. The time required for the system to clean a swimming pool depends on the time of the year, the usage of the pool and the exposure of the pool to dirt and other debris. This system while not instantaneous, normally requires just a few hours to clean an exceptionally dirty pool. Other benefits and objectives are obtained from the use of the present system include less sanitizing agent requirements to maintain the pool. Also the action of the double-ended whips 130 tends to eliminate calcium buildup and algae on the pool finish.

Figure 4:
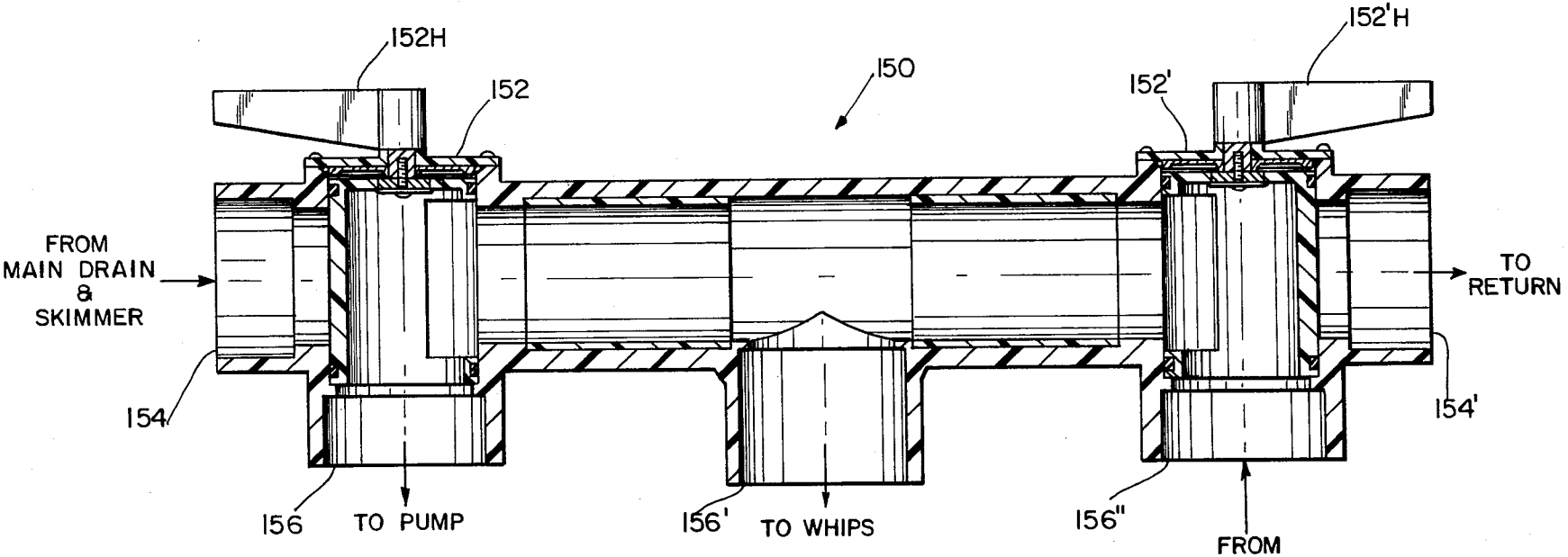
FIG. 4 is a top plan view of control valve assembly, according to the invention.
Figure 5:
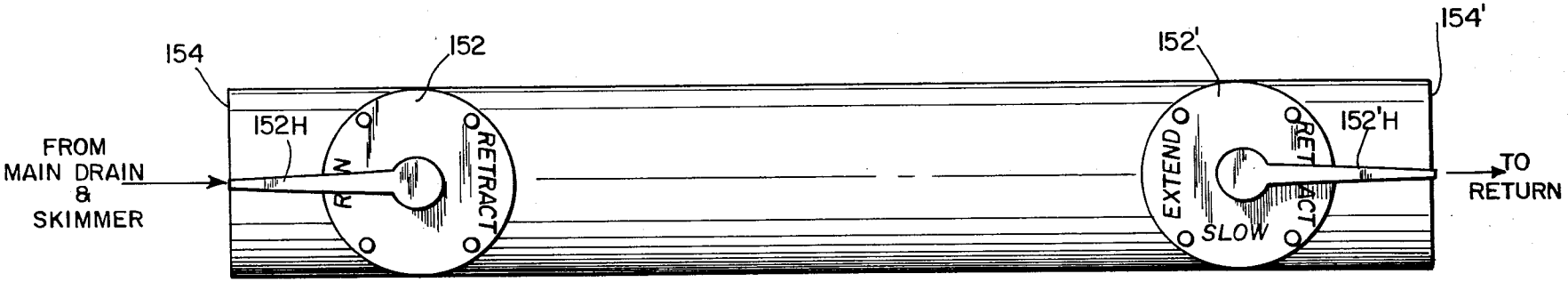
FIG. 5 is a view of control valve, taken along the lines 5—5 of FIG. 4.

With reference to FIGS. 4 and 5, control valve 150 comprising a cylindrical chambered valve provides a means of cross connection between suction line 154 return line 154' and the header line 160. The valve itself comprises cylindrical valves axially mounted with control handles on each axis thereof, said handles operating in a horizontal position when installed as shown. Handle 152H basically controls functioning of the suction lines and the opposite hand 152'H controls the operation of filter input and return line 154' to the pool. There are essentially three valve positions, namely the circulating and filtering position, the cleaning and filtering position and lastly the retract position.

The control valve is cylindrical in cross-section, consisting of five ports and two control handles. The valve is used to route the flow of water from the suction line through the Poolmaid cleaning system. It is also used to extend or retract the cleaning tubes. One handle controls the suction line to the filter and the other handle controls the return line to the pool.

When the valve handles 152H and 152'H in this "run" and "retract" respectively position, the water in the swimming pool is being circulated and filtered, the tubes are retracted and are not cleaning the interior.

In cleaning, the whips 130 are extended and moving about the pool interior. The water jetting from the end of the tubes is pushing the dirt toward the main drain 140 of the pool. The speed of the tubes and the pattern they follow over the bottom interior of the pool can be changed by slightly adjusting the position of right control handle 152'H from time to time. This adjustment will greatly improve the cleaning capability of the system.

In the retraction mode, the valves are normally in this position for a short period of time (10 to 60 seconds). They both are placed on retract. As soon as all tubes are retracted, into the housing 120, the valve 152'H should be returned to the normal filtering position. The whips will not extend in this position.

In summation, to extend the tubes in the cleaning mode, controls 152H and 152'H are each rotated in a 270 degree direction, this being the "run" function with respect to control valve 150 and an "extend" function with respect to the same. To retract the tubes in the third mode, a matter of ten to sixty seconds; controls 152H and 152'H are rotated 180 degrees from the extend position, to "retract" position—whereupon as the whips automatically retract, control 152H is again rotated back 180' to "run" position. The relative adjustment in degree of the control handles can result in water flow speed variation, open portions of the valve gates being more or less exposed to the corresponding apertures of the valve chambers.

Thus, by controlling the volume of water which is conducted to the tubes, it is possible to vary the pressure, to cause the tubes to move faster and slower, to stay on the surface of the pool shell and to lengthen or shorten the cleaning pattern of the tubes. When this adjustment is made at the valve, it does not vary the amount of water that is being filtered because the valve assembly by-passes water which is not conducted to the tubes, directly back to the pool. Filter rate is stable notwithstanding valve 150 adjustment.

I claim:

1. In the hydraulic cleaning of fluid reservoirs, said reservoirs having a fluid circulating system, comprising in sequence reservoir, reservoir drain line, pump, filter and return line, interconnected to each other:

(A) plural, extensible and retractable, open-end flexible conduits removably housed in walls of the reservoir, said conduits each having a pressure-responsive head fixed to ends thereof, responsive to the flow of fluids therethrough, to extend and retract said conduit means into and out of the fluid reservoir, for submersible fluid injecting interruption contact with each other:

(B) a valve assembly having in-line valves interposed within the fluid circulating system, comprising multichambered control to regulate modes of: first, normal filtering run of the reservoir with retracted conduits; secondly, cleaning and filtering same with extended conduits and thirdly, retracting the conduit means, precedent to return to normal run;

(B 1) a first of said valve assembly having as single control stem, said first valve interconnecting reservoir, pump return and conduits, said valve connecting the reservoir return and pump in the normal run and connecting to open end conduits in the cleaning mode;

(B 2) a second of said valve having a single control stem, interconnecting the conduits, drain and pump, whereby upon coordinate actuation of the respective valves the three modes of operation may be effected; whereby the volume and pressure applied to the conduits may be selectively controlled to effect the speed of extension for retraction and the distance of extension thereof.

2. Reservoir cleaning apparatus according to claim 1, wherein the pressure-responsive heads on each end of the respective conduits are rigid, each defining a bulbous nozzle which is of enlarged cross-section relative to the flexible conduit.

3. Reservoir cleaning apparatus according to claim 1, including rigid spiral housings for the storage of the flexible conduits, said housings being set vertically within walls of the reservoir and having direct connection with the fluid circulating system.

4. Reservoir cleaning apparatus according to claim 3, wherein the pressure-responsive heads on each end of the respective conduits are rigid, each defining a bulbous nozzle which is of enlarged cross-section relative to the flexible conduit.

5. Reservoir cleaning apparatus of claim 4, wherein the said housing each define an adapter at an open end to seat the flexible conduits in the respective extension contraction modes.

6. Reservoir cleaning apparatus operatively connected to a fluid reservoir, the reservoir having a circulating system therein and wherein a plurality of flexible hollow tubular conduits are interconnected to a source of contained fluid in the circulating system, said conduits having automatic means responsive to the flow of water therethrough to extend and retract same:

(A) rigid spiral housings for the storage of water of one each of the flexible conduits, said housings being set vertically within the walls of the reservoir and having connection with the circulating system;

(B) means to regulate directional flow of fluid in the circulating system through the hollow flexible conduits, whereby the volume and pressure applied to the conduits may be selectively controlled to effect the speed of extension and/or retraction and to control the distance of extension thereof.

7. Reservoir cleaning apparatus according to claim 6, wherein a pressure-responsive head on each end of the respective conduits are rigid, each defining a bulbous nozzle which is of elipsoid configuration in side elevation enlarged cross-section and of relative to the flexible conduit.

8. Reservoir cleaning apparatus of claim 6, wherein the regulating means comprises:

(A) valvular control means with in-line valves interposed within the fluid circulating system comprising multichambered control to regulate modes of: first, normal filtering run of the reservoir with retracted conduits; secondly, cleaning and filtering same with extended conduits and thirdly, retracting the conduit means, precedent to return to normal run;

(B) a first of said valves having a single control stem said first valve interconnecting reservoir, pump and flexible conduits, said valve connecting the reservoir drain and pump in the normal run and the connecting to open end conduits, in the cleaning mode;

(C) a second of said valve interconnecting the conduits, drain and pump, whereby upon coordinate actuation of the respective pairs of valves the three modes of operation may be effected.

9. Reservoir cleaning apparatus according to claim 8, wherein the pressure-responsive head on each end of the respective conduits are rigid, each defining a bulbous nozzle which is of enlarged cross-section, relative to the flexible conduit.

10. Reservoir cleaning apparatus according to claim 8, wherein the spiral housings each terminate in the reservoir walls, said housings each defining an adapter at an open end to seat the flexible conduits in the respective extended and retraction modes.

11. The apparatus according to claim 10, wherein the pressure-responsive head on each end of the respective conduit are rigid, each defining a bulbous nozzle which is of enlarged cross-section relative to the flexible conduit.

* * * * *